US008312625B2

(12) United States Patent
Kumakura

(10) Patent No.: US 8,312,625 B2
(45) Date of Patent: Nov. 20, 2012

(54) METHOD OF CRIMPING TERMINAL

(75) Inventor: Hideto Kumakura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/845,436

(22) Filed: Jul. 28, 2010

(65) Prior Publication Data

US 2011/0030211 A1 Feb. 10, 2011

(30) Foreign Application Priority Data

Aug. 10, 2009 (JP) ..... 2009-185802

(51) Int. Cl.
*H01R 43/04* (2006.01)

(52) U.S. Cl. ..... 29/863; 29/857; 29/861; 29/862

(58) Field of Classification Search ..... 29/857, 29/861, 862, 863
See application file for complete search history.

(56) References Cited

U.S. PATENT DOCUMENTS

| | | | | | |
|---|---|---|---|---|---|
| 4,272,879 | A | * | 6/1981 | Wigby et al. | 29/566.2 |
| 4,426,772 | A | * | 1/1984 | Collier et al. | 29/742 |
| 4,557,048 | A | * | 12/1985 | Cordeiro | 29/863 |
| 4,979,291 | A | * | 12/1990 | Phillips et al. | 29/863 |
| 6,276,052 | B1 | * | 8/2001 | Avenoso et al. | 29/751 |

FOREIGN PATENT DOCUMENTS

| | | | | |
|---|---|---|---|---|
| JP | 2007-012341 | A | | 1/2007 |
| JP | 2007012341 | A | * | 1/2007 |
| JP | 2008-181695 | A | | 8/2008 |
| JP | 2008181695 | A | * | 8/2008 |

* cited by examiner

*Primary Examiner* — Carl Arbes
(74) *Attorney, Agent, or Firm* — Sughrue Mion, PLLC

(57) ABSTRACT

An apparatus for crimping a terminal with a wire includes a first crimper and a second crimper. The first crimper presses the terminal with the wire at a first position of the wire. The second crimper presses the terminal with the wire at a second position of the wire after the first crimper presses the terminal at the first position. The first position is disposed between a tip end of the wire and the second position in an extending direction of the wire.

3 Claims, 6 Drawing Sheets

METHOD OF CRIMPING TERMINAL

BACKGROUND

This invention relates to a method of crimping and connecting a terminal to a conductor of a wire by pressing and compressing the terminal together with the conductor by the use of crimpers.

When a terminal is crimped to a conductor exposed at an end portion of a wire, the conductor is pressed and compressed together with the terminal and therefore is crushed to be extended toward an end thereof. When the conductor was thus crushed to be narrowed, a sufficient fastening force may not be obtained by the pressing and compressing operation and that a mechanical strength might be lowered. Therefore, as disclosed in Patent Document 1, there has been proposed a method of suppressing the crushing of element wires at the time of crimping a terminal to the conductor exposed at an end portion of a wire, with the conductor held between a pair of crimping piece portions of the terminal.

Among terminal press-crimping methods of the type described, there is one in which a terminal and a conductor are crimped together under pressure by using a plurality of crimpers (see Patent Document 2). In the method of Patent Document 2, all of division crimpers arranged in juxtaposed relation in an axial direction of a wire are pressed down to the same height to crimp the wire and a conductor crimping portion of the terminal together uniformly as a whole, and then part of the division crimpers is further pressed down to press a localized portion of the conductor crimping portion more strongly, thereby crimping the terminal to the wire.

In order to enhance contact reliability, a post treatment such as the coating of a coating agent is applied to the terminal and the conductor integrated with each other by the crimping connection. However, when the outer shape of the terminal and conductor crimped together became complicated, for example, because of spreading of the distal end of the crimped conductor or of the formation of irregularities such as convex and concave portions on the face of the terminal, it is difficult to effect the post treatment evenly over the entire area, and also a projecting portion of the terminal is liable to be caught by a connector housing at the time of mounting the terminal in the connector housing.

In the method described in Patent Document 2, the terminal can be strongly crimped and connected to the conductor while suppressing the forward extending of the conductor and the narrowing thereof, the technique of Patent Document 2 is not sufficient to simplify the outer shape of the terminal integrated with the conductor by the pressing and compressing operation.

[Patent Document 1] Japanese Patent Publication Number 2007-012341

[Patent Document 2] Japanese Patent Publication Number 2008-181695

SUMMARY

It is therefore one advantageous aspect of the present invention to provide a method of crimping a terminal and an apparatus for crimping the terminal which can solve the above problems.

According to one aspect of the invention, there is provided a method of crimping a terminal with a wire, comprising:

pressing the terminal with the wire at a first position of the wire; and pressing the terminal with the wire at a second position of the wire after pressing the terminal at the first position, wherein the first position is disposed between a tip end of the wire and the second position in an extending direction of the wire.

The method may further comprise releasing a pressure applied by the pressing at the first position and the second position.

The method may further comprise pressing the terminal with the wire at a third position of the wire after pressing the terminal at the second position. In this method, the third position is disposed between the second position and a sheath of the wire in the extending direction of the wire, and the first position and the second position are disposed at a wire barrel of the terminal, and the third position is disposed at an insulation barrel of the terminal.

According to another aspect of the invention, there is provided an apparatus for crimping a terminal with a wire, comprising:

a first crimper configured to press the terminal with the wire at a first position of the wire; and a second crimper configured to press the terminal with the wire at a second position of the wire after the first crimper presses the terminal at the first position, wherein the first position is disposed between a tip end of the wire and the second position in an extending direction of the wire.

The apparatus further comprise a releaser configured to release a pressure applied by the first crimper and the second crimper.

The apparatus may further comprise a third crimper configured to press the terminal with the wire at a third position of the wire after the second crimper presses the terminal at the second position. In this apparatus, the third position is disposed between the second position and a sheath of the wire in the extending direction of the wire, and the first position and the second position are disposed at a wire barrel of the terminal, and the third position is disposed at an insulation barrel of the terminal.

DETAILED DESCRIPTION OF EXEMPLIFIED EMBODIMENTS

Exemplified embodiments of the invention are described below in detail with reference to the accompanying drawings.

The terms "upward-downward direction" and "forward-rearward direction" used in the following description correspond to a top-bottom direction and a left-right direction of the sheets respectively. The upward-downward direction, the forward-rearward direction and are given for description purposes, and these may of course be different from actual dispositions.

Figure 1:
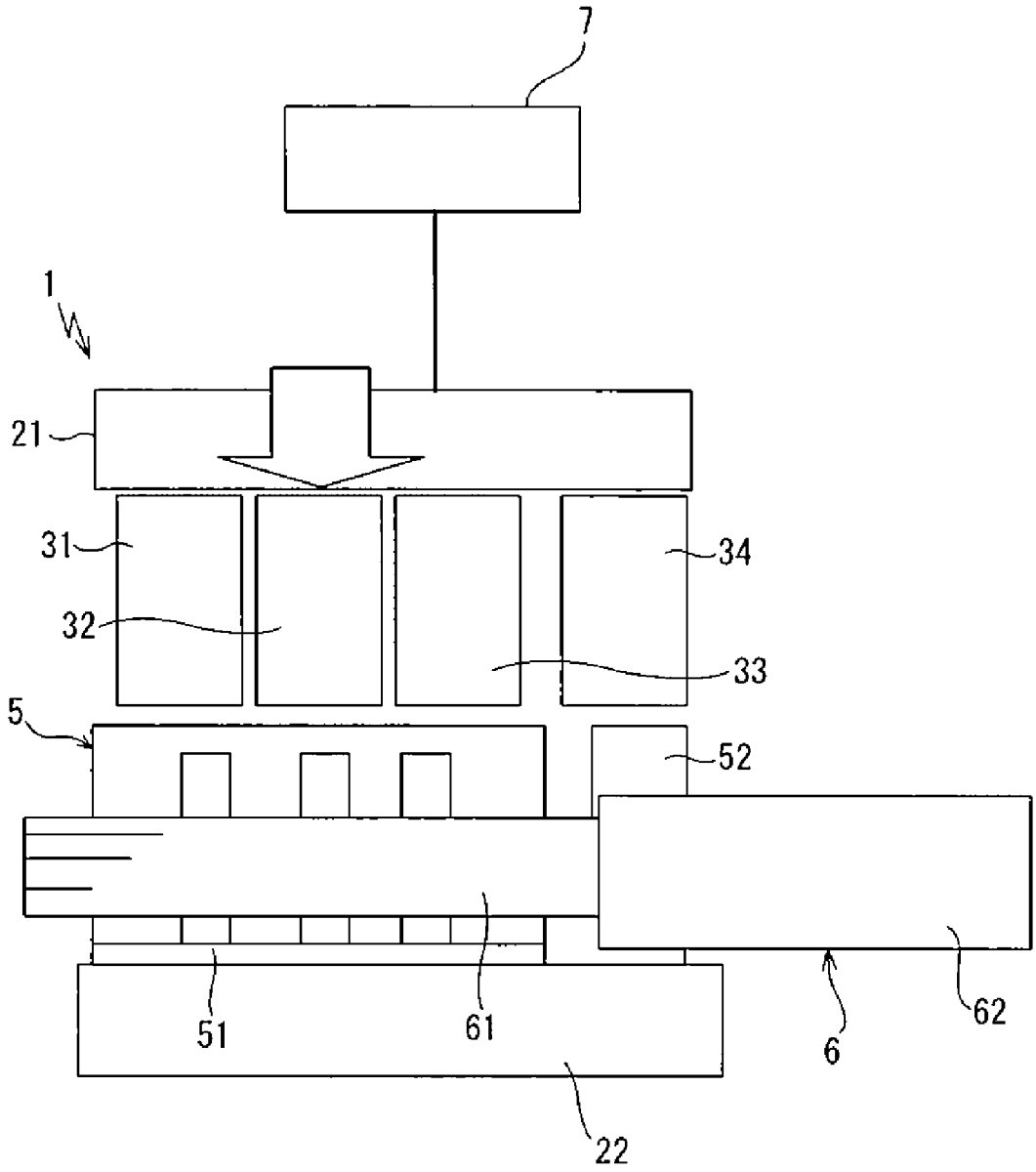
FIG. 1 is a side view schematically showing an apparatus for crimping a terminal according to one embodiment of the present invention.

As shown in FIG. 1, the apparatus 1 comprises the crimpers 31 to 34 supported on a support portion 21, and pressing means 7 for pressing the crimpers 31 to 34 against the terminal 5 to compressively press the terminal 5. The crimpers 31 to 34 are arranged in juxtaposed relation in a direction of extending of the terminal 5 placed on a rest 22, and are supported on the support portion 21. The pressing means 7 presses the crimpers 31 to 34 sequentially against the terminal 5 (as indicated by an arrow in FIG. 1) in the order from the crimper 31 located near to a tip end portion of the terminal 5, thereby pressing and compressing the terminal 5 together with a conductor 61 of a wire 6, and then separates all of the crimpers 31 to 34, pressed against the terminal 5, from the terminal 5, thereby canceling the pressing of the terminal 5. In other wards, the pressing means 7 may perform as a releasing means.

In this embodiment, forward in the forward-rearward direction corresponds to a direction toward tip end of the wire 6, and down ward in the upward-downward direction corresponds to a direction in which the crimpers 31 to 34 press the terminal 5.

The terminal 5 to be pressed by the crimpers 31 to 34 has an insulation barrel 52 formed at a rear end of a wire barrel 51. Although not shown in the drawings, a terminal box to which a mating terminal is to be connected is formed at the front side of the wire barrel 51. The conductor 61 exposed by removing a sheath 62 from an end portion of the wire 6 is received within the terminal 5, and in this condition the terminal 5 is crimped and connected to the conductor 61.

Next, the method of crimping the terminal 5 to the conductor 61 of the wire 6 by the use of the apparatus 1 will be described with reference to FIGS. 2A to 2C.

Figure 2A:
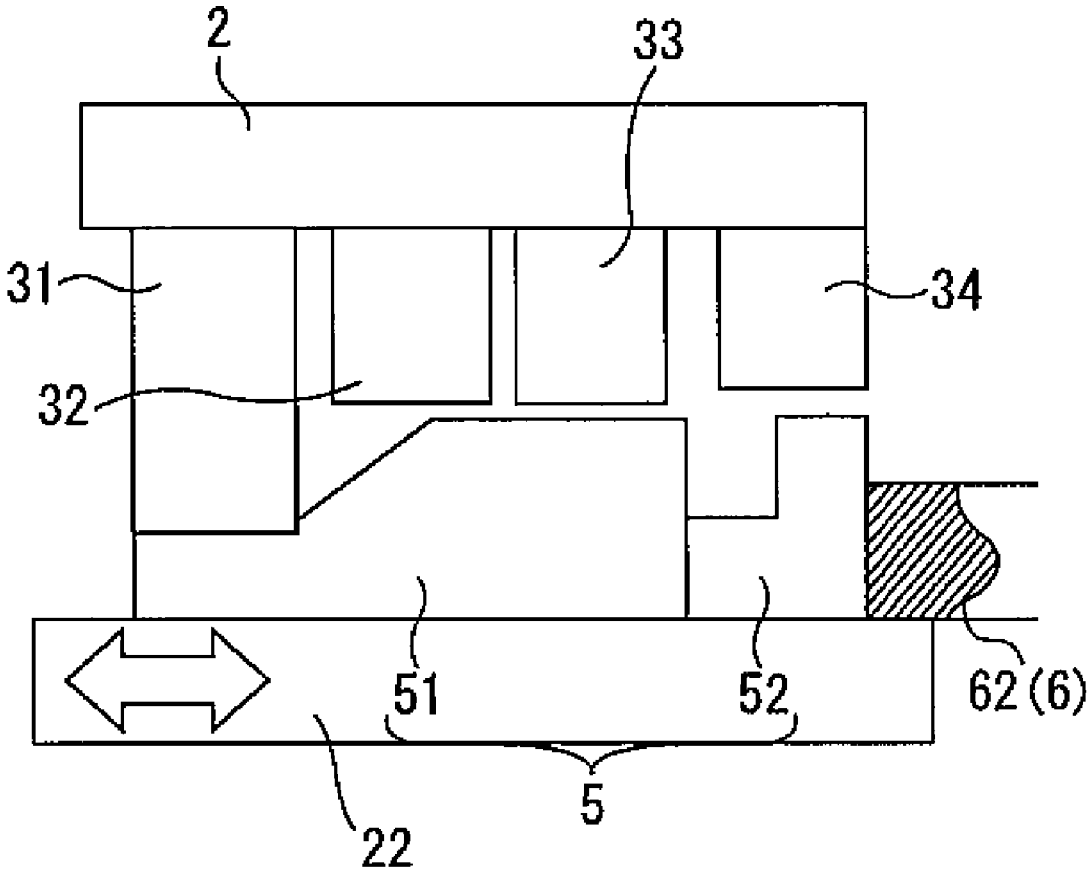
FIGS. 2A to 2C are views showing a method of crimping the terminal performed by the apparatus shown in FIG. 1, showing the manner of pressing and compressing a terminal step by step by a plurality of crimpers.

For crimping the terminal 5 by the apparatus 1, first, the crimper 31 is pressed against an upper face of the wire barrel 51 placed on the rest 22 and receiving the wire 6 therein, thereby pressing and compressing a front end portion of the wire barrel 51 together with the conductor 61 of the wire 6, as shown in FIG. 2A. At this time, the terminal 5, together with the conductor 61, is extended in the forward-rearward direction, as indicated by a thick arrow in FIG. 2A.

Figure 2B:
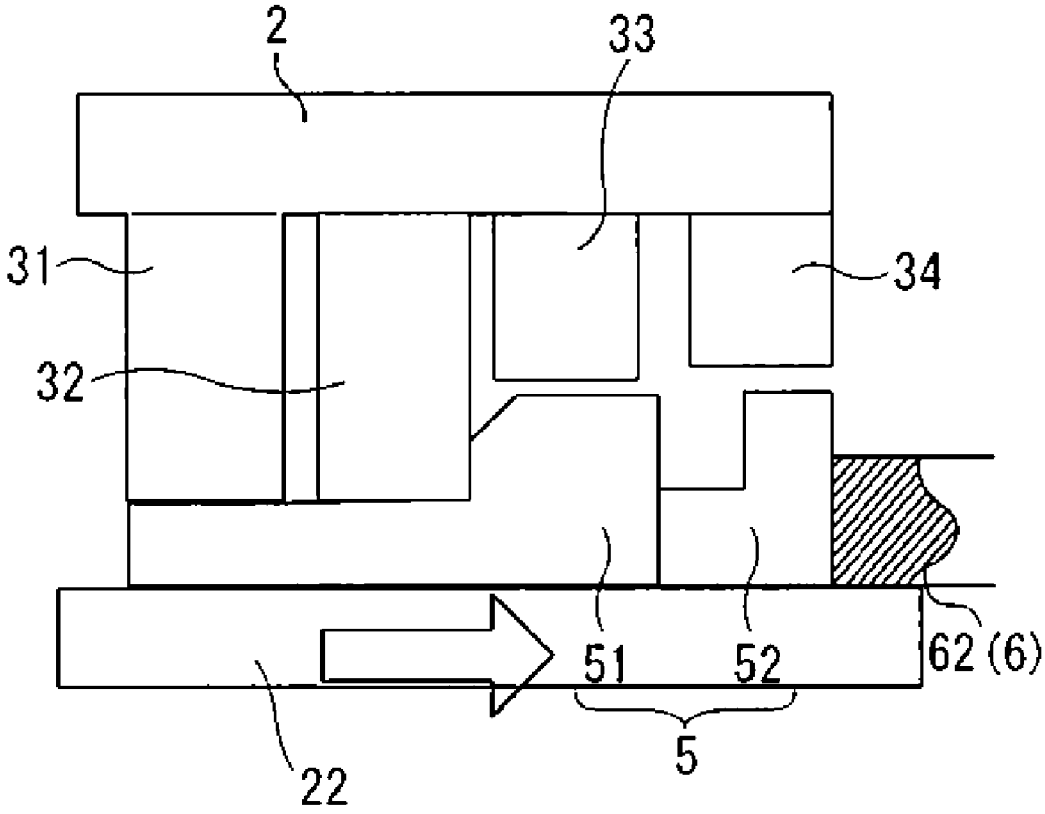

Then, while the crimper 31 is kept pressed against the upper face of the wire barrel 51, the crimper 32 is pressed against that portion of the upper face of the wire barrel 51 disposed rearwardly of that portion of this upper face against which the crimper 31 is pressed, thereby pressing and compressing a central portion in the forward-rearward direction of the wire barrel 51 together with the conductor 61, as shown in FIG. 2B. As this time, the terminal 5 and the conductor 61 are restricted to be deformed toward their front ends since their front end portions are already pressed and compressed by the crimper 31, and therefore the terminal 5 and the conductor 61 are extended rearwardly as indicated by a thick arrow in FIG. 2B.

Figure 2C:
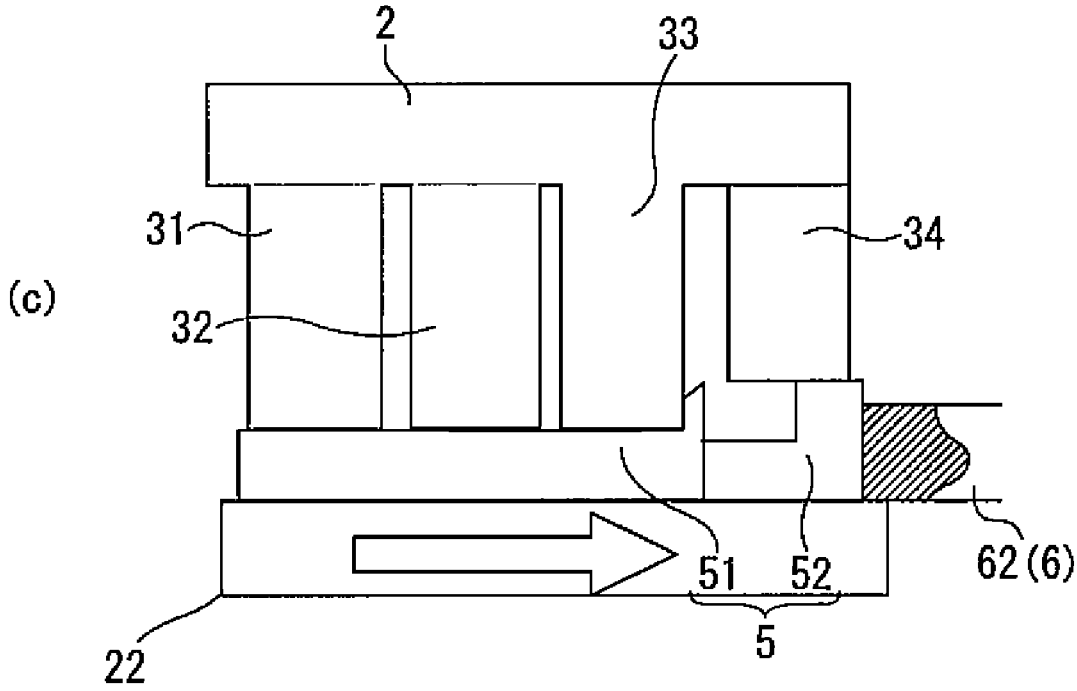

Then, while the crimpers 31 and 32 are kept pressed against the upper face of the wire barrel 51, the crimper 33 is pressed against that portion of the upper face of the wire barrel 51 disposed rearwardly of that portion of this upper face against which the crimper 32 is pressed, thereby pressing and compressing a rear end portion of the wire barrel 51 together with the conductor 61, as shown in FIG. 2C. As this time, the terminal 5 and the conductor 61 are restricted to be deformed toward their front ends since their front end portion and central portions are already pressed and compressed by the crimpers 31 and 32, and therefore the terminal 5 and the conductor 61 are extended rearwardly as indicated by a thick arrow in FIG. 2C.

Thus, the crimpers 31 to 33 are sequentially pressed against the upper face of the wire barrel 51 in this order from the front end side, and by doing so, the terminal 5, together with the conductor 61 of the wire 6, is pressed and compressed, so that the conductor 61 is press-fastened.

Thereafter, while the crimpers 31 to 33 are kept pressed against the upper face of the wire barrel 51, the crimper 34 is pressed against an upper face of the insulation barrel 52, thereby pressing and compressing the insulation barrel 52 together with the conductor 61, thus press-fastening the conductor 61.

In other wards, a first one of the crimpers 31 to 33 presses the wire barrel 51 with the wire 6 at a first position of the wire 6, a second one of the crimper 31 to 33 presses the wire barrel 51 with the wire 6 at a second position of the wire 6 after the first one of the crimpers 31 to 33 presses the wire barrel 51 at the first position, and a third crimper 34 presses the insulation barrel 52 with the wire 6 at a third position of the wire 6 after the second one of the crimpers 31 to 33 presses the wire barrel 51 at the second position. The first position is disposed between the tip end of the wire 6 and the second position in an extending direction of the wire 6, the third position is disposed between the second position and a sheath 62 of the wire in an extending direction of the wire.

After the pressing and compressing operations by the crimpers 31 to 34 are finished, the crimpers 31 and 34 are moved upward, and the crimpers 31 to 33 are separated from the upper face of the wire barrel 51, and also the crimper 34 is separated from the upper face of the insulation barrel 52, thus canceling the pressing against the terminal 5.

Thus, the crimpers 31 to 34 are sequentially pressed against the wire barrel 51, receiving the distal (or front) end portion of the conductor 61 therein, from the front end toward the rear end, and by doing so, the conductor 61 press-fastened to the wire barrel 51 and the wire barrel 51 can be restricted to be deformed toward their front ends since the relevant portions thereof are already pressed and deformed.

Figure 3A:
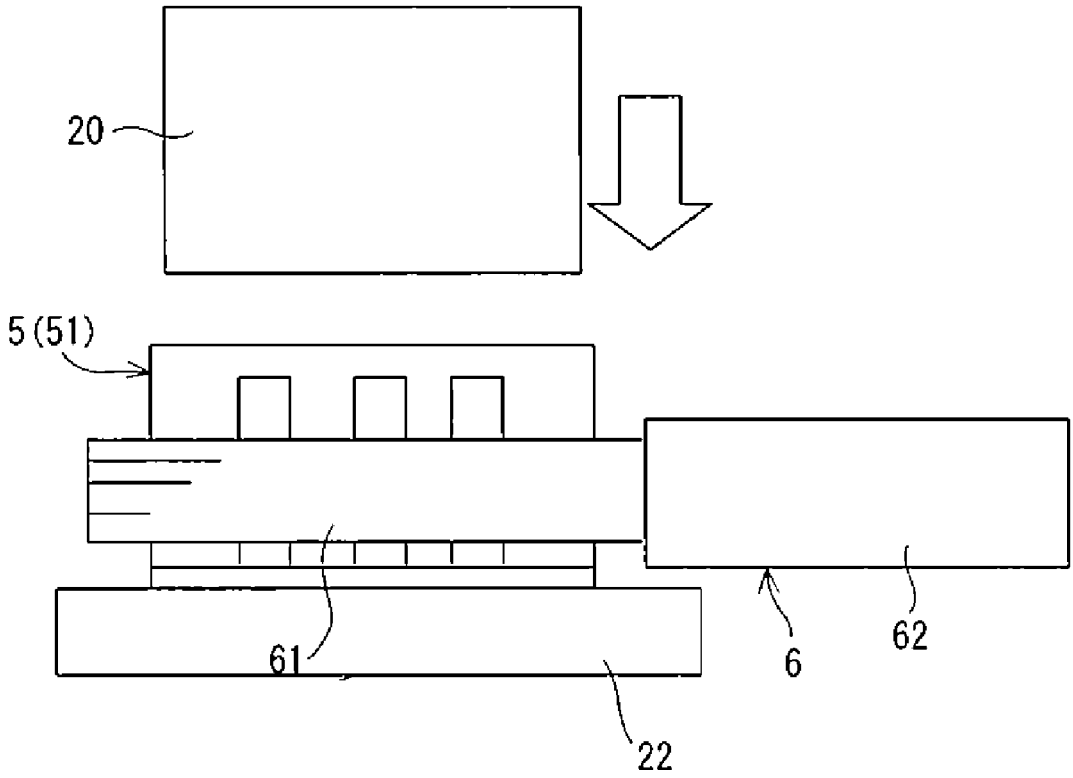
FIGS. 3A and 3B are side views showing a conventional method in which a terminal is pressed and compressed at one time by one crimper.
Figure 3B:
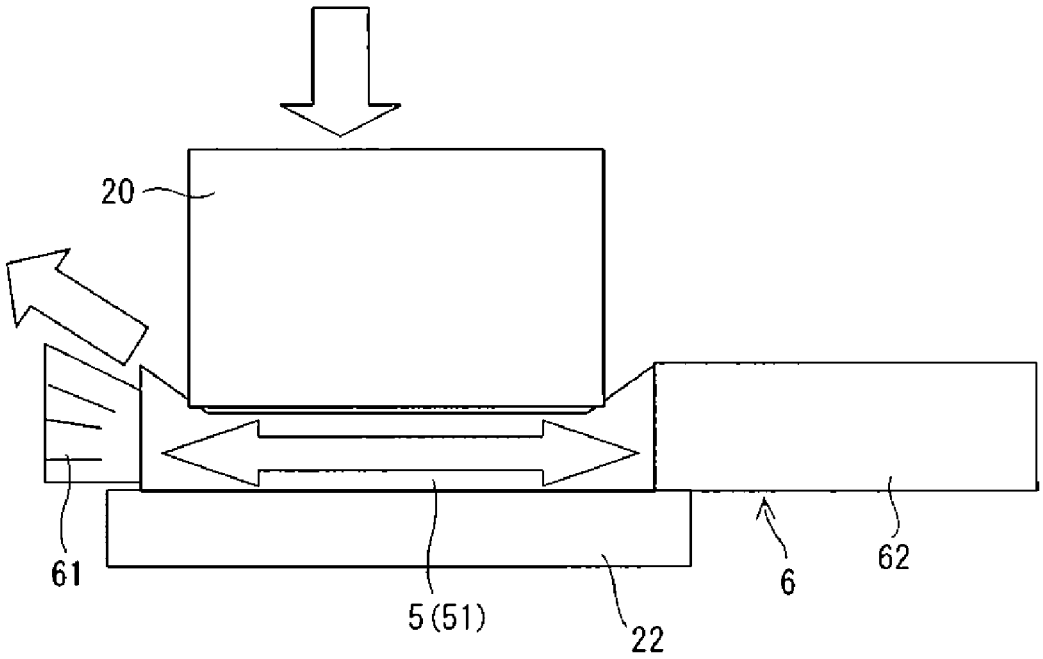

For example, in the case where one crimper 20 is pressed against the upper face of the terminal 5, thereby pressing and compressing the terminal 5 together with the conductor 61 as indicated by a thick arrow in FIG. 3A, the terminal 5 and the conductor 61 are crushed and deformed at the same time over the entire length of the terminal 5 from the front end to the rear end, and therefore the terminal 5 and the conductor 61 are deformed toward the front end and the rear end, as shown in FIG. 3B. As a result, the conductor 61 projects from the front end of the terminal 5, so that the front end portion of the conductor 61 is spread.

On the other hand, in the terminal press-crimping method of the present invention in which the crimpers 31 to 34 are sequentially pressed against the terminal 5 from the front end so as to effect the pressing and compressing operation, the deformation of the terminal 5 and conductor 61 toward their front end portions already pressed and compressed by the crimpers 31 to 34, and therefore the terminal 5 and the conductor 61 are mainly deformed toward their rear ends. Therefore, the projection of the conductor 61 from the front end of the terminal 5 can be suppressed.

In addition, the crimpers 31 to 34 can be moved downward to the same level or height so as to press the terminal 5 and the conductor 61, and therefore the face of the terminal 5 pressed by the crimpers 31 to 34 can be made flat, so that irregularities such as convex and concave portions are prevented from developing on the face of the terminal 5 crimped to the conductor 61. As a result, the outer shape of the terminal 5 and conductor 61 crimped together can be controlled to be simplified.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

As described above, in this embodiment, the crimpers 31 to 34 are sequentially pressed against the terminal 5 from the front end of the conductor 61 to press and compress the terminal 5 together with the conductor 61, and thereafter the pressing and compressing operations by the crimpers 31 to 34 are canceled, and by doing so, the pressed face of the terminal 5 can be made flat while suppressing the extending of the conductor 61 toward the front end. Therefore, the shape of the terminal 5 and conductor 61 integrated with each other by the pressing and compressing operation can be simplified, and the time and labor required for a post treatment can be reduced, and the terminal can be prevented from being caught by a connector housing at the time of mounting the terminal in the connector housing.

In the above embodiment, the relevant portions of the terminal 5 are sequentially pressed and compressed from the front end by the crimpers 31 to 34. However, the number of the crimpers used for pressing and compressing the terminal 5 are arbitrary in so far as at least the front end portion and rear end portion of the terminal 5 can be pressed and compressed independently of each other.

For example, in the above embodiment, the insulation barrel 52 is pressed and compressed by the crimper 34 after the rear end portion of the wire barrel 51 is pressed and compressed by the crimper 33. However, not only the rear end portion of the wire barrel 51 but also the insulation barrel 52 may be simultaneously pressed and compressed by the crimper 33. In another modified example, the pressing and compressing operation by the crimper 33 and the pressing and compressing operation by the crimper 34 may be effected simultaneously.

Furthermore, in the above embodiment, although the terminal 5 placed on the rest 22 is pressed and compressed from the upper side by the crimper 31 to 34, the direction of pressing and compressing of the terminal 5 by the crimpers 31 to 34 is arbitrary. For example, each of the crimpers 31 to 34 may be replaced by a pair of upper and lower crimpers adapted to be pressed respectively against the upper and lower faces of the terminal 5 so as to press and compress the same, or may be replaced by a pair of right and left crimpers adapted to be pressed respectively against the right and left side faces of the terminal 5 so as to press and compress the same.

The disclosures of Japanese Patent Application No. 2009-185802 filed Aug. 10, 2009 including specification, drawings and claims is incorporated herein by reference in its entirety.

What is claimed is:

1. A method of crimping a terminal with a wire, comprising:

pressing the terminal with the wire at a first position of the wire; and pressing the terminal with the wire at a second position of the wire after pressing the terminal at the first position, wherein the first position is disposed between a tip end of the wire and the second position in an extending direction of the wire, wherein the first position and the second position are disposed on a wire barrel of the terminal.

2. The method as set forth in claim 1, further comprising:

releasing a pressure applied by the pressing at the first position and the second position.

3. The method as set forth in claim 1, further comprising:

pressing the terminal with the wire at a third position of the wire after pressing the terminal at the second position, wherein the third position is disposed between the second position and a sheath of the wire in the extending direction of the wire, and wherein the third position is disposed on an insulation barrel of the terminal.

* * * * *